US010808659B2

(12) United States Patent
Kleineberg

(10) Patent No.: US 10,808,659 B2
(45) Date of Patent: Oct. 20, 2020

(54) FUEL DELIVERY UNIT

(71) Applicant: CPT Group GmbH, Hannover (DE)

(72) Inventor: Stefan Kleineberg, Rodgau (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 16/336,051

(22) PCT Filed: Sep. 21, 2017

(86) PCT No.: PCT/EP2017/073897
§ 371 (c)(1),
(2) Date: Mar. 22, 2019

(87) PCT Pub. No.: WO2018/055032
PCT Pub. Date: Mar. 29, 2018

(65) Prior Publication Data

US 2019/0226435 A1 Jul. 25, 2019

(30) Foreign Application Priority Data

Sep. 23, 2016 (DE) ..... 10 2016 218 294

(51) Int. Cl.
*F02M 37/10* (2006.01)
*F02M 37/02* (2006.01)
*F02M 37/00* (2006.01)

(52) U.S. Cl.
CPC ..... *F02M 37/106* (2013.01); *F02M 37/0023* (2013.01); *F02M 37/025* (2013.01)

(58) Field of Classification Search
CPC ..... F02M 37/106; F02M 37/0023; F02M 37/025; F02M 37/0041; F02M 37/08;
(Continued)

(56) References Cited

U.S. PATENT DOCUMENTS 5,452,701 A * 9/1995 Tuckey ..... B60K 15/077 123/509
5,525,048 A 6/1996 Tuckey
(Continued)

FOREIGN PATENT DOCUMENTS

DE 199 14 269 10/2000
DE 19843318 C5 3/2007
(Continued)

OTHER PUBLICATIONS

International Search Report issued in corresponding PCT application No. PCT/EP2017/073897.
(Continued)

*Primary Examiner* — George C Jin
(74) *Attorney, Agent, or Firm* — Cozen O'Connor

(57) ABSTRACT

A fuel delivery unit in a fuel tank includes a fuel pump drivable by an electric motor. The fuel pump has at least one suction jet pump for delivering fuel, the suction jet pump being operated by a propulsion jet that is deliverable by the fuel pump. The fuel pump is arranged in a swirl pot, which is fillable by the suction jet pump, and the fuel pump has a first outlet, through which fuel is deliverable to a consumer, and a second outlet openable or closable by a valve.

10 Claims, 2 Drawing Sheets

(58) Field of Classification Search
CPC ..... F02M 37/10; F02M 37/22; F02M 37/44; F02M 37/0017; F02M 37/0076; F04C 11/008; F04C 15/0049; F02D 29/047
See application file for complete search history.

(56) References Cited

U.S. PATENT DOCUMENTS

| | | | | |
|---|---|---|---|---|
| 6,311,725 | B1 * | 11/2001 | Hamada | B01D 29/606 137/565.13 |
| 2003/0111113 | A1 * | 6/2003 | Shih | F16K 5/0657 137/375 |
| 2003/0226548 | A1 | 12/2003 | Herzog et al. | |
| 2004/0123908 | A1 * | 7/2004 | Tiziani | F16K 1/12 137/556.6 |
| 2006/0231079 | A1 * | 10/2006 | Paluszewski | F02M 37/025 123/514 |
| 2011/0139278 | A1 * | 6/2011 | Kawajiri | F02M 37/025 137/565.01 |
| 2015/0354721 | A1 * | 12/2015 | Holt | F16K 31/105 251/129.2 |

FOREIGN PATENT DOCUMENTS

| | | |
|---|---|---|
| DE | 102006024456 | 11/2007 |
| DE | 10 2007 039 861 | 2/2009 |
| DE | 10 2008 060 090 | 6/2009 |
| DE | 10 2008 054 380 | 6/2010 |
| DE | 10 2014 225 315 | 6/2016 |
| EP | 2 803 848 | 11/2014 |
| JP | 2009-537744 | 10/2009 |
| JP | 2014 092041 | 5/2014 |
| JP | 2008-121454 | 5/2018 |
| WO | WO 2018-055032 | 3/2018 |

OTHER PUBLICATIONS

Written Opinion issued in corresponding PCT application No. PCT/EP2017/073897.
German Office Action dated May 18, 2017 issued in corresponding German application No. 10 2016 218 294.3.
Office Action dated Mar. 2, 2020 issued in Korean Patent Application No. 2019-7011097.
Office Action dated Jul. 17, 2020 issued in India Patent Application No. 201937005576.

* cited by examiner

FUEL DELIVERY UNIT

CROSS REFERENCE TO RELATED APPLICATIONS

This is a U.S. national stage of application No. PCT/EP2017/073897, filed on Sep. 21, 2017, which claims priority to German Application No. 10 2016 218 294.3, filed Sep. 23, 2016, the content of each of which is incorporated herein by reference.

FIELD OF THE INVENTION

The invention relates to a fuel delivery unit in a fuel tank, having a fuel pump that is drivable by an electric motor and having at least one suction jet pump for delivering fuel, said suction jet pump being operated by a propulsion jet that is able to be delivered by the fuel pump, wherein the fuel pump is arranged in a swirl pot, which is fillable by the suction jet pump, and wherein the fuel pump has a first outlet, through which fuel is able to be delivered to a consumer.

DESCRIPTION OF THE PRIOR ART

In tank systems, typically delivery pumps are used to deliver the medium stored in the tank. This serves to deliver the stored medium to a particular consumer. In one specific case, the tank system is, for example, one for storing fuel for supplying an internal combustion engine, as is conventional, for example, in a large number of motor vehicles. To deliver the stored medium, different delivery pumps can be used. In the specific case of fuel, which is described in the following text by way of example, but without excluding applications that do not involve fuel, use is made for this purpose of what are known as fuel pumps.

In the prior art a wide variety of designs of electrically operated fuel pumps are known. In such pumps, as a result of a voltage being applied to the electric motor connected to a pump stage, a fuel volume can be delivered.

Furthermore, suction jet pumps are known. Suction jet pumps are based on the principle that a negative pressure is generated by the delivery of a propulsion jet through an intake manifold in the region of an intake point, with the result that fuel located in the vicinity is carried along. Therefore, for its operation, the suction jet pump requires in each case a propulsion jet that is generated by the delivery of fuel through another fuel pump. Widely known, for example, are combinations of an electrically operated fuel pump with one or more suction jet pumps.

The suction jet pumps serve here, for example, for the predelivery of fuel into a swirl pot, from which the electrically operated fuel pump, usually designed as a submersible pump, discharges the fuel. The suction jet pumps are distributed in the tank so that complete emptying is possible regardless of the particular driving situation and in particular the inclination of the vehicle. This is advantageous in particular in the case of a tank having a plurality of chambers in which, from a particular filling level in the tank, a fluidic connection between the individual chambers is ensured only by the delivery line of the suction jet pumps.

A drawback of the solutions in the prior art is in particular that the suction jet pumps are operated permanently as soon as the electrically operated fuel pump delivers fuel, i.e., as soon as a propulsion jet is delivered by the suction jet pump. As a result of the permanent operation of the suction jet pumps, which is in principle not always necessary, since the additional delivery capacity of the suction jet pump is not required in every situation, an unnecessarily large amount of energy is consumed.

Solutions are known in which individual suction jet pumps are switched on and off by switchable valves. However, this is particularly disadvantageous because additional active components, the switchable valves, have to be provided, an additional driver has to be provided in the control unit for fuel delivery, and also additional wiring for controlling the valves has to be provided.

SUMMARY OF THE INVENTION

Therefore, it is an object of the present invention to provide a fuel delivery unit, which allows easy and needs-based activation and deactivation of a suction jet pump.

In accordance with one aspect of the invention, this object relating to the fuel delivery unit may be achieved by a fuel delivery unit having a fuel pump that is drivable by an electric motor and having at least one suction jet pump for delivering fuel, the suction jet pump being operated by a propulsion jet that is able to be delivered by the fuel pump, wherein the fuel pump is arranged in a swirl pot, which is fillable by the suction jet pump, and wherein the fuel pump has a first outlet, through which fuel is able to be delivered to a consumer, wherein the fuel pump has a second outlet, wherein the second outlet is openable or closable by a valve.

The example here relates to a fuel delivery unit. However, the principle of the invention is also readily applicable to other delivery units for liquid media.

The fuel pump has a first outlet, through which the fuel delivered from the swirl pot by the fuel pump can be delivered out of the tank to a consumer. In the case of a fuel delivery unit, the consumer is preferably an internal combustion engine. Fuel pumps of this type having an outlet are known from the prior art and available in a variety of ways. According to an aspect of the invention, the fuel pump has a second outlet, through which a partial volume of the fuel delivered by the fuel pump can be discharged. This discharged partial volume is preferably used to supply a suction jet pump in the tank with a propulsion jet. By way of the propulsion jet, fuel can be delivered by the suction jet pump, this fuel being delivered, for example, from the tank into the swirl pot, in which the fuel pump is arranged.

Since the propulsion jet does not have to be delivered permanently to the suction jet pump, since it is simply not necessary in some driving situations, the second outlet is selectively closed or opened by a valve. As a result, the suction jet pump can be activated or deactivated by opening or closing the second outlet.

It is particularly advantageous when a propulsion jet, with which one or more suction jet pumps are drivable, is able to be delivered through the second outlet. This is advantageous in order, for example, to deliver fuel from remote regions of the tank to the intake region of the fuel pump. In particular, multi-chamber tanks or very rugged tanks often do not offer the possibility of the fuel being able to flow, at every filling level, toward the intake region of the fuel pump simply by gravity.

It is also advantageous when the valve is adjustable by the electric motor via a mechanical coupling to the electric motor. As a result of the valve being actuated via a mechanical coupling to the electric motor, particularly easy adjustment of the valve can be achieved. In particular, no additional active components are required, which would require a separate power supply or control. This minimizes the additional costs required. Preferably, the valve is connected via a coupling to the electric motor or the shaft driven by the electric motor, such that the rotational movement of the electric motor can be transmitted to the valve or the coupling. It may also be advantageous when the rotational movement of the electric motor is converted via a gear-like component. As a result, it is possible for example for the rotational movement of the electric motor to be converted into a movement in translation. Depending on the configuration of the valve, this may be advantageous.

According to another aspect of the invention, the position of the valve is changeable by a rotational movement of the electric motor that drives the fuel pump, the rotational movement being in the opposite direction to the regular rotational movement for fuel delivery.

The regular rotational movement means the direction of rotation of the electric motor in which the electric motor is rotated in order to deliver fuel from the tank to a consumer. Preferably, fuel pumps are designed for a defined direction of rotation, such that fuel is delivered to the consumer only when the electric motor is rotated in this direction of rotation. In modern fuel pumps, use is made, inter alia, of electrically commutated motors, which can be rotated in both directions of rotation by a corresponding influence on the electrical exciting field. As a result of a suitable mechanical design of the coupling between the electric motor and the valve, the valve can be controlled selectively depending on the direction of rotation of the electric motor.

It is also preferable for the valve to be movable by the electric motor via a coupling. This is advantageous, since the valve can be selectively controlled in this way. In principle, an electrically actuated coupling could also be provided, which can be opened and closed via a switching command. However, this would be contrary to the actual concept of the invention, since the simplest possible actuation of the valve is specifically desired, and so preferably a mechanical coupling is provided for connecting the valve to the electric motor.

Furthermore, it is advantageous when the position of the valve is changeable by a reversal of the direction of rotation of the electric motor of less than 360 degrees, preferably less than 180 degrees and particularly preferably less than 90 degrees.

Preferably, the position of the valve is influenced only by a partial rotation of the electric motor in the opposite direction to the regular direction of rotation. This is intended to prevent a situation in which, as a result of longer-lasting rotation counter to the regular direction of rotation, fuel is no longer delivered or even return delivery of the fuel occurs. Moreover, the actuation of the valve should take place quickly, and so the shortest possible rotational travel is advantageous. Furthermore, the time required to make the electric motor rotate in the regular direction again after a reversal of the direction of rotation is shortened because large rotational angles in the opposite direction are not achieved.

Furthermore, it is advantageous when the position of the valve is changeable by a reversal of the direction of rotation of the electric motor of at least 75 degrees. A sufficiently large rotational movement in the opposite direction is necessary in order to preclude unintentional actuation of the valve. Furthermore, in a mechanical coupling, a minimum rotational travel is required in order to be able to transmit a sufficiently large movement to the valve in order to either open or close it.

It is also expedient when the coupling is formed in two parts, wherein the two coupling parts are rotatable relative to one another about the axis of rotation of the coupling by a reversal of the direction of rotation, wherein a movement of at least one coupling part in translation along the axis of rotation is able to be generated by the rotation of the two coupling parts relative to one another. Such a configuration is advantageous to convert the rotational movement of the electric motor into a movement in translation and thus to ensure suitable actuation of the valve. The two coupling parts may have, for example, two link-like contact surfaces, with which they bear against each other. As a result of a relative movement of the two coupling parts to one another, the rotational movement can be converted into a movement in translation. This can be achieved, for example, by the provision of bevels and ascending or descending trajectories on which the coupling parts slide.

Particularly preferably, the coupling parts are designed such that they interlock with one another and do not undergo any relative movement with respect to one another when the electric motor is moved in the regular direction of rotation and thus fuel is delivered. Preferably, in the case of a rotational movement in the regular direction of rotation, the actuation of the valve is avoided, and so it remains in the position set last in each case. Thus, it is selectively possible for an open valve to remain open or, conversely, for a closed valve to remain closed.

Furthermore, it is advantageous when the movement of the at least one coupling part in translation along the axis of rotation is transmissible to a valve disk, wherein the second outlet is openable or closable by the valve disk. As a result of the movement of a valve disk in translation, an opening can be selectively opened or closed. The second outlet can thus be opened or closed easily, with the result that the delivery of fuel to the suction jet pump in order to generate a propulsion jet can be started or stopped.

Furthermore, it is expedient when the valve disk has a catch, wherein the valve disk is fixed by the catch in the respective position that has been brought about by the movement in translation of the at least one coupling part.

The catch is advantageous in order to allow the valve disk to remain in one position, so that the valve remains either open or closed. One possible latching mechanism provides, for example, barbs that engage in recesses provided for this purpose when the valve disk is moved. As a result of a combination of a movement in translation with a rotational movement, it is possible for the catch also to be released again, in that, for example, the barbs are rotated relative to the recesses and the valve disk can then be moved in translation toward the coupling or away from the coupling on a smooth inner face of the channel in which the valve disk is guided. The principle functions in a similar manner to a catch, as it is known for example from ballpoint pens.

Furthermore, a wide variety of other embodiments are providable that allow latching of the valve disk in an open position and in a closed position and each allow the valve disk to move between these two positions by way of a rotational movement of the electric motor counter to the regular direction of rotation.

It is also advantageous when the catch of the valve disk is releasable by the movement in translation of the at least one coupling part and/or by the rotational movement of the at least one coupling part.

This is particularly advantageous to ensure that the valve disk can be moved both into the closed position and into the open position by the same rotational movement of the electric motor. For this purpose, it is particularly advantageous for the valve disk to be moved, for example. from one of the two positions into the second position by a first rotational movement of the electric motor counter to the regular direction of rotation and to be securely locked there, and to be released from the second position by a second rotational movement of the electric motor in the same direction and to be pushed back to the first position, wherein the valve disk remains in its respective position in the case of a rotational movement of the electric motor in the regular direction of rotation.

BRIEF DESCRIPTION OF THE DRAWINGS

Advantageous refinements of the present invention are explained in detail in the following text on the basis of exemplary embodiments with reference to the drawings, in which.

DETAILED DESCRIPTION OF THE PRESENTLY PREFERRED EMBODIMENTS

Figure 1:
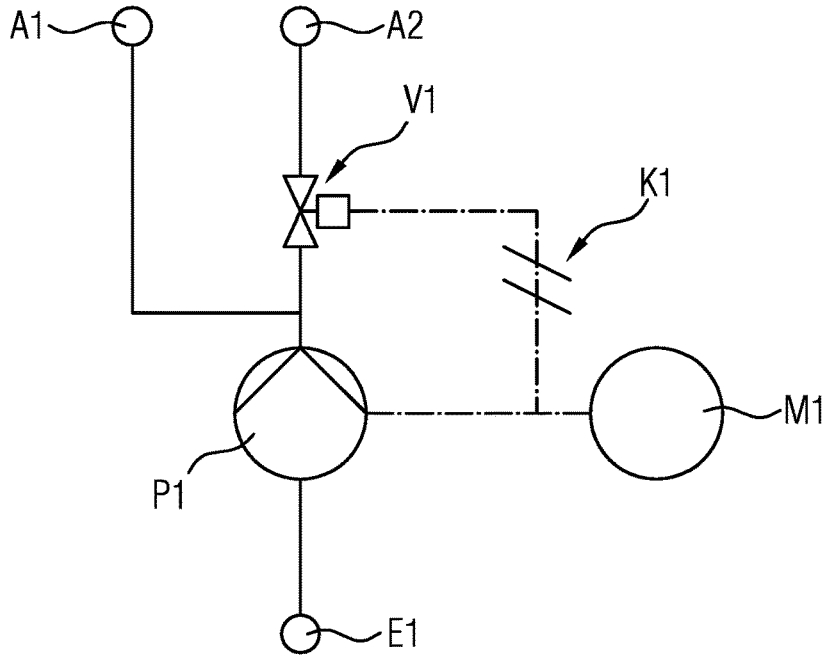
FIG. 1 shows a schematic hydraulic circuit diagram of a fuel pump, having an electric motor, two outlets, a valve and a coupling.

FIG. 1 shows a hydraulic circuit diagram of a fuel pump according to the invention. The references A1 and A2 denote the outlets of the fuel pump. The outlet A1 leads to the consumer, for example the internal combustion engine, which is downstream of the fuel pump. The outlet A2 leads to one or more suction jet pumps, which can be supplied with a propulsion jet through the outlet A2.

The outlet A2 can be opened or completely closed by the valve V1. The suction jet pump connected downstream of the outlet A2 can thus be activated or deactivated by allowing the fuel delivered in order to generate a propulsion jet to flow through the valve V1 or not.

The electric motor M1 drives the pump stage P1 of the fuel pump. Via a coupling K1, the valve V1 is likewise connected to the electric motor M1 and can be moved by the electric motor M1. The coupling K1 is configured such that the valve V1 is not moved in a direction of rotation of the electric motor M1, but rather can be moved in the opposite direction of rotation of the electric motor M1 from the open position to the closed position, or vice versa from the closed position to the open position.

The electric motor M1 is electrically connected to the power source E1. By changing the polarity of the exciting field, the direction of rotation of the electric motor M1 can be changed, causing it to rotate either clockwise or counterclockwise.

Figure 2:
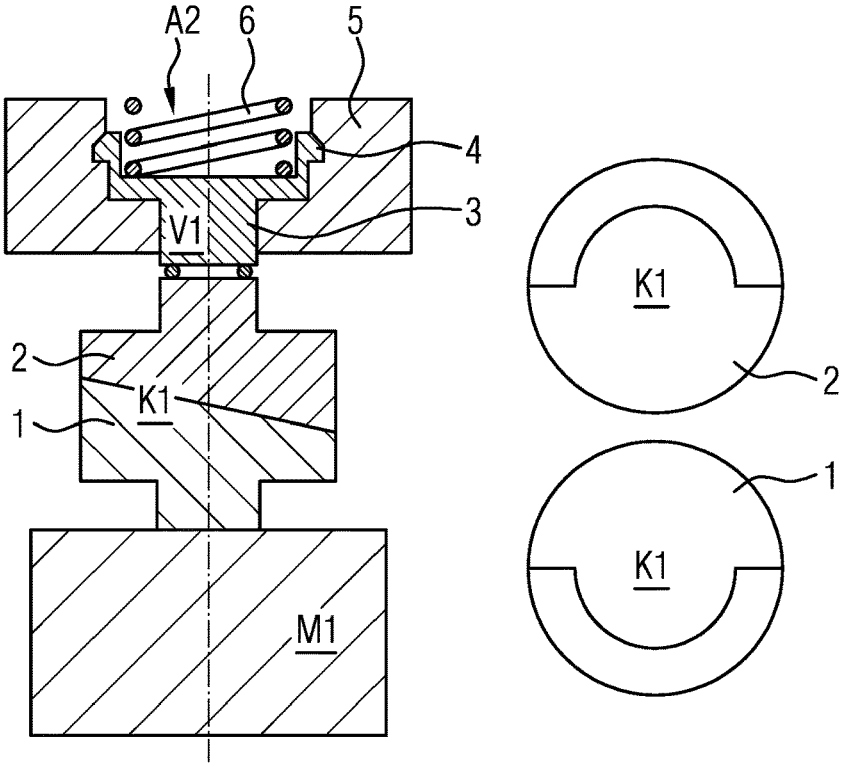
FIG. 2 shows a basic diagram of the valve and the coupling by way of which the valve is connected to the electric motor.

FIG. 2 shows a schematic view of the coupling K1 of the fuel pump in FIG. 1.

The coupling K1 is formed by two coupling parts 1 and 2 in the exemplary embodiment in FIG. 1. The coupling part 1 is connected to the output shaft of the electric motor M1 and is thus co-rotated in accordance with the rotational movement of the electric motor M1.

The coupling part 2 is connected to the valve disk 3 of the valve V1 and also bears against the coupling part 1. If the coupling part 1 is rotated counter to the regular direction of rotation by the electric motor M1 in order to operate the fuel pump, the coupling part 1 is rotated relative to the coupling part 2. As a result of the configuration of the coupling parts 1 and 2, a movement in translation along the axis of rotation towards the valve V1 is thus produced, with the result that the valve disk 3 is moved in translation.

For this purpose, the coupling parts 1 and 2 can be designed, for example, in a link-like manner and have bevels. In addition to the movement of the coupling part 2 in translation, the coupling part 2 is transmitted to at least part of the rotational movement of the coupling part 1 to the valve disk 3.

The valve disk 3 has a latching device 4 formed by barbs, by which the valve disk 3 can be fixed in the housing 5, which forms the outlet A2. The housing 5 may, for this purpose, have recesses into which the barbs can engage. As a result of the valve disk 3 being rotated out of the latched position, the barbs can be released from the recesses and the valve disk 3 can be moved in translation and rotation relative to the housing 5.

The valve disk 3 is supported with respect to the housing 5 via the spring 6, with the result that the return movement of the valve disk towards the coupling K1 is supported. Without a rotational movement of the electric motor M1 counter to the regular direction of rotation, the valve disk 3 remains in its respectively last position either in the open or in the closed state. The position of the valve V1 is thus determined entirely by the rotational movement of the electric motor M1.

Figure 3:
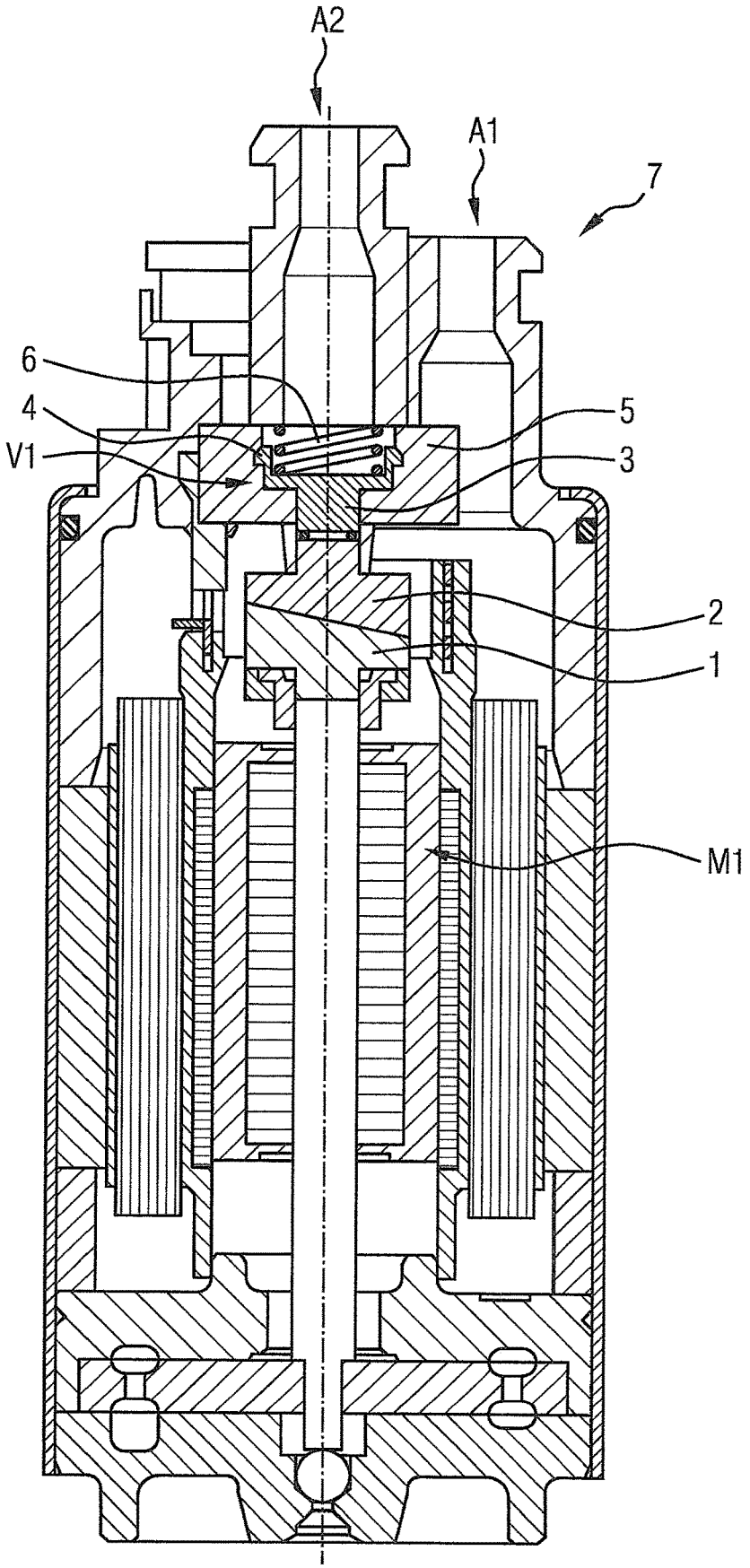
FIG. 3 shows a cross-sectional view through a fuel pump with two outlets, wherein one of the outlets is closable by a valve connected to the electric motor by a coupling.

FIG. 3 shows a cross section through a fuel pump 7 with the two outlets A1 and A2 in the upper end region. The outlet A2 can be opened and closed via the valve V1 already shown in FIGS. 1 and 2. The structure known from FIG. 2 is integrated into the fuel pump 7 above the electric motor M1. The reference signs of FIG. 3 match those of FIG. 2, where identical elements are shown.

FIG. 3 shows a possible exemplary embodiment of a fuel pump for a fuel delivery unit according to the invention. Like a conventional fuel pump, the fuel pump 7 has, in its lower end region, an intake opening through which it can draw in the fuel from its environment. The fuel is then delivered upward by the fuel pump and, in the exemplary embodiment in FIG. 3, is discharged through the outlet A1 and, depending on the opening state of the valve V1, through the outlet A2.

The exemplary embodiments in FIGS. 1 to 3 have in particular no limiting nature and serve merely to illustrate the concept of the invention.

Although the preceding description has described exemplary embodiments, it is to be noted that a multiplicity of variations are possible. Moreover, it is to be noted that the exemplary embodiments are merely examples which are not intended to restrict the scope protection, the applications and the construction in any way. Rather, a person skilled in the art is given a guideline for the implementation of at least one exemplary embodiment by the preceding description, it being possible for various modifications to be performed, in particular with regard to the function and arrangement of the described constituent parts, without departing from the scope of protection as arises from the claims and the equivalent combinations of features.

The invention claimed is:

1. A fuel delivery unit in a fuel tank, comprising:

an electric motor (M1);

a swirl pot; and a fuel pump (P1, 7) arranged in the swirl pot and drivable by the electric motor (M1), wherein:

the fuel pump (P1, 7) is configured to deliver a propulsion jet, the fuel pump (P1, 7) has one or more suction jet pumps configured to deliver fuel, the one or more suction jet pumps being operable by the propulsion jet delivered by the fuel pump (P1, 7), the swirl pot is fillable by the one or more suction jet pumps, the fuel pump (P1, 7) has a first outlet (A1), through which fuel is deliverable to a consumer, and the fuel pump (P1, 7) has a second outlet (A2), the second outlet (A2) being openable or closable by a valve (V1), the valve (V1) being movable by the electric motor (M1) via a coupling (K1) configured to convert a rotational movement of the electric motor (M1) to a translational movement for actuation of the valve (V1).

2. The fuel delivery unit as claimed in claim 1, wherein the propulsion jet, with which the one or more suction jet pumps are drivable, is deliverable through the second outlet (A2).

3. The fuel delivery unit as claimed in claim 1, wherein the coupling (K1) is a mechanical coupling, and wherein the valve (V1) is adjustable by the electric motor (M1) via the mechanical coupling (K1).

4. The fuel delivery unit as claimed in claim 1, wherein the valve's (V1) position is changeable by a rotational movement of the electric motor (M1) that drives the fuel pump (P1, 7), the rotational movement being in a direction opposite to a direction of regular rotational movement for fuel delivery.

5. The fuel delivery unit as claimed in claim 1, wherein the valve's (V1) position is changeable by a reversal of a direction of rotation of the electric motor (M1) of less than 360 degrees, or less than 180 degrees, or less than 90 degrees.

6. The fuel delivery unit as claimed in claim 1, wherein the valve's (V1) position is changeable by a reversal of a direction of rotation of the electric motor (M1) of at least 75 degrees.

7. A fuel delivery unit in a fuel tank, comprising:

an electric motor (M1);

a swirl pot; and a fuel pump (P1, 7) arranged in the swirl pot and drivable by the electric motor (M1), wherein:

the fuel pump (P1, 7) is configured to deliver a propulsion jet, the fuel pump (P1, 7) has one or more suction jet pumps configured to deliver fuel, the one or more suction jet pumps being operable by the propulsion jet delivered by the fuel pump (P1, 7), the swirl pot is fillable by the one or more suction jet pumps, the fuel pump (P1, 7) has a first outlet (A1), through which fuel is deliverable to a consumer, the fuel pump (P1, 7) has a second outlet (A2), the second outlet (A2) being openable or closable by a valve (V1), the valve (V1) being movable by the electric motor (M1) via a coupling (K1), and the coupling (K1) comprises first and second coupling parts (1, 2), the first and second coupling parts (1, 2) being rotatable relative to one another about an axis of rotation of the coupling (K1) by a reversal of a direction of rotation, wherein a movement of at least one of the first and second coupling parts (2) in translation along the axis of rotation is generatable by the rotation of the first and second coupling parts (1, 2) relative to one another.

8. The fuel delivery unit as claimed in claim 7, wherein the movement of the at least one of the first and second coupling parts (2) in translation along the axis of rotation is transmissible to a valve disk (3), the second outlet (A2) being openable or closable by the valve disk (3).

9. The fuel delivery unit as claimed in claim 8, wherein the valve disk (3) has a catch, the valve disk (3) being fixed by the catch in a respective position that has been brought about by the movement in translation of the at least one of the first and second coupling parts (2).

10. The fuel delivery unit as claimed in claim 9, wherein the catch of the valve disk (3) is releasable by the movement in translation of the at least one of the first and second coupling parts (2) and/or by the rotational movement of the at least one of the first and second coupling parts (2).

* * * * *